US006892633B2

(12) United States Patent
Both et al.

(10) Patent No.: US 6,892,633 B2
(45) Date of Patent: May 17, 2005

(54) TOOLS SUPPORTING AND HEATING DEVICE

(75) Inventors: Francois Both, Vaulruz (CH); Michel Piguet, Renens (CH)

(73) Assignee: Bobst SA (CH)

( * ) Notice: Subject to any disclaimer, the term of this patent is extended or adjusted under 35 U.S.C. 154(b) by 0 days.

(21) Appl. No.: 10/826,043

(22) Filed: Apr. 15, 2004

(65) Prior Publication Data

US 2004/0206254 A1 Oct. 21, 2004

(30) Foreign Application Priority Data

Apr. 16, 2003 (CH) ..... 0684/03

(51) Int. Cl.[7] ..... B44B 5/00

(52) U.S. Cl. ..... 101/27; 219/216; 219/390; 219/525; 101/27; 101/480; 101/487; 101/21; 101/25; 101/31; 101/32

(58) Field of Search ..... 219/216, 390, 219/525; 101/27, 480, 487, 21, 25, 31, 32

(56) References Cited

U.S. PATENT DOCUMENTS 3,311,692 A * 3/1967 Baird ..... 264/293
3,547,751 A * 12/1970 Morgan ..... 428/188
3,584,572 A * 6/1971 Apicella ..... 101/24
3,683,807 A * 8/1972 Anderson ..... 101/487
3,753,850 A * 8/1973 Brunet ..... 428/349
4,455,933 A * 6/1984 Bichsel ..... 101/27
4,665,303 A * 5/1987 Miyakawa et al. ..... 219/216
4,867,057 A * 9/1989 Bradley et al. ..... 101/27
5,298,031 A * 3/1994 Gabay et al. ..... 8/471
5,517,910 A * 5/1996 Skahan ..... 101/27
5,562,796 A * 10/1996 Ertel ..... 156/498
5,722,320 A * 3/1998 Meyer ..... 101/32
6,149,764 A * 11/2000 Steiner et al. ..... 156/540
6,575,089 B2 * 6/2003 He et al. ..... 101/32
2003/0183611 A1 * 10/2003 Gergor et al.

FOREIGN PATENT DOCUMENTS

FR 2639005 A1 * 5/1990 ..... B44C/1/14

* cited by examiner

*Primary Examiner*—Andrew H. Hirshfeld
*Assistant Examiner*—Andrea H. Evans
(74) *Attorney, Agent, or Firm*—Ostrolenk, Faber, Gerb & Soffen, LLP

(57) ABSTRACT

Tools supporting and heating device for tools like printing plates, used for diecutting and hot pressure transfer of portions of metallic films on a substrate. This device comprises a base plate applied against one of the sides of the honeycomb chase. This base plate is made of a sequence of at least one insulating surface and of at least one conducting surface enabling to feed at least one heating device intended to be inserted inside each one of said apertures in order to heat a printing plate fastened against a second side of the honeycomb chase.

17 Claims, 2 Drawing Sheets

TOOLS SUPPORTING AND HEATING DEVICE

BACKGROUND OF THE INVENTION

The present invention relates to a tools supporting and heating device for tools like printing plates, used for hot embossing and/or diecutting and hot pressure transfer of portions of metallic films, mainly onto a paper or cardboard substrate.

Such operations are carried out for example in a machine including a platen press, in which a cardboard sheet is introduced to be printed with related print motifs issued from a usual metallized foil or film conveyed between this sheet and the heated upper platen. The pressure needed for transferring the metallized film on the cardboard sheet is controlled by the lower movable beam of the platen press. This movable beam is usually equipped with a stamping die, to which the counterparts of each plate-shaped tool of the upper beam are secured. These tools are usually defined for the one skilled in the art with the term of printing plates. Thus, in a recurring vertical movement, the lower beam is pressing the counterparts against the related printing plates, and sandwiching the cardboard sheet above which the metallized foil is arranged. The foil is thus in direct contact with the plate heated through the upper beam. The upper beam enables diecutting and transferring the portion of the metallized foil, corresponding to the printing plate imprint, on the cardboard sheet. Once the transfer has been carried out, the lower beam comes down again and the printed cardboard sheet is removed from the platen press so that the press is free again to receive a new sheet to be stamped. In the meantime, the stamping foil is unrolled so that a new blank surface is connected with the printing plates. The diecutting and hot embossing process can then be repeated.

To ensure that the printing plates are set according to various needs, a relatively thick plate, provided with a plurality of evenly distributed apertures is already in use. Such plates are commonly known as honeycomb chase. They are directly secured to the heating surface of the upper beam. The securing of the printing plates on the honeycomb chase is carried out with fastening clamps which have one end which grasps the edges of the printing plate and another end which is slipped into and tightened in the apertures by a clamping pin and an eccentric, for example. Such securing means are described in more detail in patent CH691361.

The heating of the printing plates is thus realized through the honeycomb chase, which is itself directly associated with the upper heating platen. That platen is heavy and massive, which enables handling strong pressures generated by the lower movable platen at the time of the stamping of the metallized foil and even sometimes at the time of a simultaneous sheet embossing operation. The stamping and embossing forces vary according to the whole surface of the patterns to be stamped and can typically range from 1 to 5 MN, for surfaces of worked sheets of about one square meter. The device that enables heating the honeycomb chase and consequently the secured printing plates is located inside the upper heating platen.

Such a platen usually includes a massive block, interdependent from the machine frame. At least one supporting plate is arranged against the lower surface of the block. A plurality of parallel pipes are machined in the thickness of the block, enabling the fitting of about twenty electric heaters. This supporting plate is furthermore divided into ten areas, so that the heaters located in each area can be independently operated. To that end, there is an electric supply network inside the upper beam, and it connects each heaters group to an exterior power input. To cause the temperature of the printing plates to register to an optimum value, usually ranging between 50° C. and 180° C., the electric board is equipped with a thermostatic regulation device connected to a plurality of temperature sensors. The sensors are usually located the closer to the honeycomb chase and distributed according to areas related to the various groups of heaters.

Patent FR2'639'005 refers to a hot gilding device similar to the abovementioned one. The heating device of one of the platens comprises six heating units which are interdependent and are separated the one from the other by spaces of about one millimeter. Each heating unit involves a stacking of various plates. The honeycomb chase enabling the later securing of the plates is made of an upper plate with a plurality of bored holes. Under that plate, a copper plate is acting as a heat dispatcher. Another plate milled with grooves and provided with the heating resistances is located underneath the latter. This set of plates finally lays on a last one comprising compact plastic leaves in alternation with alveolate leaves. This last plate constitutes a thermal insulation avoiding excess heat dispersion to the rest of the platen.

Such heating devices have many drawbacks that do not enable capacities improvement of these machines and that make them also not really polyvalent. Among these drawbacks, one will mainly notice the huge thermal inertia of several massive parts of these heating devices which decreases the machine capacities when one needs a quick adaptation to new temperature data. It can be the case, during a same stamping work, when a batch of cardboard sheets is not any more at the same temperature as the preceding batch. The reasons for such a difference of temperature between these two sheets batches is directly related to their storage area, where ambient temperatures were unequal, or is due to a rate increase of the machine. When processing with cardboard sheets at lower temperature, it will be necessary to compensate for the calorific loss of the printing plates coming in contact with these sheets within the shortest delays. However the thermal inertia of all units used in the known heating devices can require not less than ten minutes before the temperature sensors can register the temperature variation. The reaction time for correcting such sudden temperature variations is thus very long compared to the production rate, which can be about 4000 even 7000 sheets per hour.

Another drawback is that the fitting of known heating devices produces an important heat loss spreading in the important mass of the numerous plates, frames and other metal parts connected to the printing plates. This heat loss results in an excessive energy consumption compared to the energy just needed for the printing plates to be at their working temperature, which means a relative low output for said devices, inversely proportional to the energy consumption costs.

Another drawback of the devices is the required pre-heating times before they are operational. Pre-heating times can sometimes be about several hours which prevents any use of the machine. Moreover, they depend on several variable factors, namely on the initial temperature of the plate, on the working temperature of the printing plates, on the conductivity and the mass of materials used. Inversely, the thermal inertia of these materials prevents the machine from fast cooling and thus makes any handling more complicated, like the disassembly of the printing plates followed by the preparation for other work, as long as the temperature has not reached a suitable level.

Another drawback is that the various assembly parts connected to the heating device have to deal with dilatations and other physical constraints. These dilatations generate on one hand mechanical tensions and, on the other hand, important size changes must be taken into account at the time of the cold positioning of the printing plates for hot processing.

Another drawback is the required sorting of the heating areas that cannot be reduced or removed. In case only one printing plate infringes on a small portion of an adjacent heating area, it would nevertheless be necessary to control the heating of this whole adjacent area to ensure the temperature homogeneity of the printing plate. This homogenization is indeed necessary to ensure a right transfer on the whole surface of the printing plate.

Another drawback is the difficulty for current heating systems to regulate their temperature. As the heating areas have relatively rough surfaces, it is generally difficult to obtain a satisfactory temperature regulation of the areas located at the edge of the honeycomb chase. Indeed, these peripheral areas are subject to a temperature gradient showing a temperature loss of the printing plate as soon as the edge of the heating plate is reached. This loss is produced either naturally by surrounding conditions, where the ambient air is at a quite lower temperature than the one of the printing plates, or artificially by a blower located upstream of the platen press, used to facilitate the stripping of the rest of the metallized foil, once the latter is stamped on the cardboard sheet. Thus, if these areas are located near-by the periphery of the heating plate, their temperature can never be homogeneous. The result will be a real loss of quality of the transfer of the metallized foil, causing even the appearance of some defects on said portions.

Another drawback is that heating systems like these are not easy to repair and maintain. The main units are subject to breakdowns in electric resistances and temperature sensors. However, if one of those parts should be defective, it would then not be possible any more to use the related heating area and it could in fact paralyse the whole machine if one, or several printing plates, would stay, even partially, in this area.

Another drawback is that an important infrastructure is needed in the platen to heat the printing plates. However, all mechanical and electric embodiments do not enable in such a case the convertibility of that kind of machine into one intended for the cardboard sheets cutting. The cutting stations of a packaging production line are nevertheless, excepted for some modifications, identical to the platen presses of the invention. However, to carry out such a conversion, it is necessary to remove the honeycomb chase from the platens, the printing plates and the other specific tools in order to replace them by suitable tools such as a cutting die, provided with cutting rules and a cutting plate acting as support and counterpart. Since these transformations require sometimes heavy handling, the machine must be stopped and is thus not productive during that time.

SUMMARY OF THE INVENTION

The aim of the present invention is to overcome at least partly the abovementioned drawbacks. To that end, the present invention relates to a fast and convivial adaptability for cutting and stamping machines thanks to a device that is much easier for setting and removing from a usual plate. The time needed to carry out these transformations is thus substantially reduced and the versatility of these production machines is much improved. It also increases the energy efficiency of the heating of the printing plates, allows choosing and precisely targeting the various areas to heat, decreases the necessary heating power and thus reduces the electricity consumption costs. The present invention also offers the possibility, thanks to a self-regulation system integrated into each heating device, to not systematically resort to the fitting of temperature sensors inside the heated upper head. Moreover, it reduces considerably the cooling and heating times of the machine, respectively before and after a required work.

These aims are reached thanks to a tools supporting and heating device according to the invention. The invention concerns a support and heating device for tools for hot embossing or diecutting with hot pressure transfer of metallic film portions onto a substrate. The device comprises at least one platen, and at least one honeycomb chase having two opposite parallel sides with a plurality of apertures at spaced apart locations in the chase. A base plate is secured against one of the sides of the honeycomb chase. The base plate is comprised of at least one insulating surface alternating with at least one conducting surface. A plurality of heating devices with each inserted into one of the apertures in the honeycomb chase. The heating devices are operable to heat a printing plate that is selectively securable against the second side of the honeycomb chase. The printing plate is positioned for cooperating with the at least one platen for hot embossing or diecutting and hot pressure transferring a metallic film portion onto the substrate.

Other features and advantages of the present invention will become apparent from the following description of the invention which refers to the accompanying drawings.

BRIEF DESCRIPTION OF THE DRAWINGS

The invention will be more clearly understood from the study of an embodiment, given by way of non-limitative example and illustrated by the following drawings, in which.

DESCRIPTION OF PREFERRED EMBODIMENTS

Figure 1:
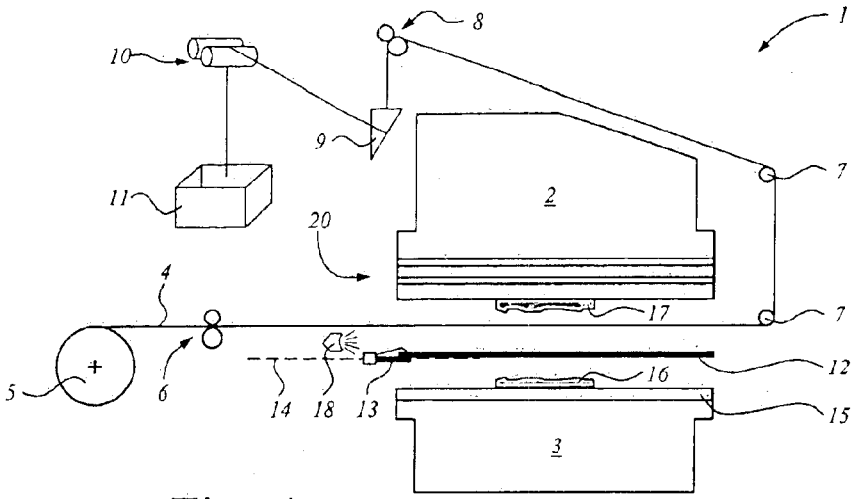
FIG. 1 shows a general diagram of the main parts of a stamping machine equipped with the subject matter of the invention.

FIG. 1 shows schematically the main units of a platen press 1 comprising the tools supporting and heating device 20 of the invention. The platen press 1 includes primarily a fixed upper beam 2 and a vertically movable lower platen 3. At least one metallized film or one metallized foil 4 is conveyed between these platens, being unrolled from a roll 5 by a pair of advance shafts 6. A plurality of tension rollers 7 turns this stamping foil around the fixed upper beam 2. It is tended by a pair of drive rollers 8 before leaving the machine by means of an idling device 9 and being removed by a pair of brushes 10 towards a collecting pan 11.

Underneath the metallized foil 4, a substrate, such as a cardboard sheet 12 or a sheet another material, is laid on the lower platen through a conveyor, for example a gripper bar 13 mounted on a gripper rod chains 14, as partly illustrated. The lower beam 3 is equipped with a stamping die 15 against which at least one counter printing plate 16 is secured.

The tools supporting and heating device 20 of the invention is mounted against the lower side of the upper beam 2. The device is equipped with at least one printing plate 17 that is intended to be heated. At each platen press cycle, a new sheet 12 is conveyed and positioned by means of the gripper bars 13 on the lower platen 3 equipped with counter printing plates 16. At the same time, a new portion of metallized foil 4 is unrolled from the roll 5 and is stopped in front of the printing plates 17. As soon as the lower platen 3 is raised, the platen press 1 stops, while each counter printing plate 16 comes to encase into the related printing plate 17. The sheet 12 and the portion of the metallized foil 4 are sandwiched between these two devices and thus is strongly compressed one against the other. This compression pressure, to which is added the heat released by the heated printing plate, enables diecutting of the imprint of the printing plate 17 into the metallized foil 4 and to stick this imprint onto the sheet 12 by means of a specific adhesive matter related to each one of the metallized foils. At the time of the aperture of the platen press by lowering the lower platen, a blower 18 is insufflating air in order to enable the stripping of the sheet 12 with respect to the remaining framework of the metallized foil that deems sometimes to be gluing. The stamped sheet 12 is then withdrawn out of the press by means of the gripper bar 13 and a new cycle can begin.

Figure 2:
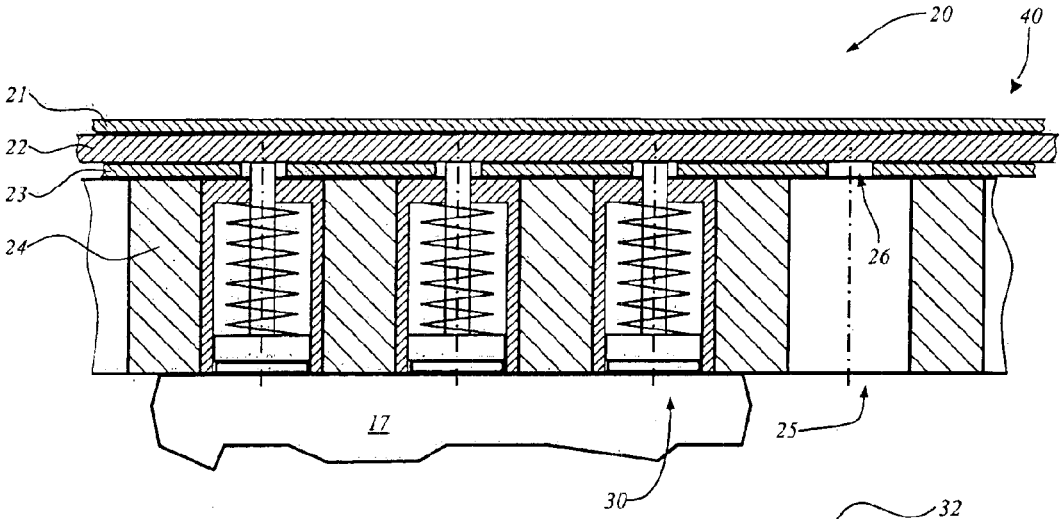
FIG. 2 shows schematically and partially a vertical cross section of the subject matter of the invention is comprised.

FIG. 2 illustrates more details of the tools supporting and heating device 20 that enables the securing of the printing plates 17 of the upper beam and the raising of their temperature up to an optimal processing value. Device 20 comprises particularly a first insulating plate 21, which is a poor electricity conductor, even also a thermal insulator, against which is supported a bottom plate 22, made of copper for example. An insulating surface 23 with an almost infinite ohmic strength is fastened flat on the front of this plate. The whole device comprising the insulating plate 21, the bottom plate 22 and the insulating surface 23 constitutes a whole unit producing a unit called a base plate 40. A honeycomb chase 24 is then secured against this base plate 40, more precisely against the insulating surface 23. This chase is absolutely the same as those used for hot stamping operations in the known platen presses. Such a honeycomb chase comprises a plurality of apertures 25, evenly distributed on its whole surface, and has dimensions appreciably equal to the maximum format of the sheets to be processed into said press. As such a chase is extremely expensive, one will understand that one advantageously does not necessarily need this specific chase in order to implement the subject matter of the invention.

Apertures 25 are preferentially circular shaped and extend completely through the thickness of the honeycomb chase 24. A hole 26 is bored into the insulating surface 23 to be seen through each aperture 25, so that it is also possible to see a part of the bottom plate 22. Apertures 25 and holes 26 are preferentially concentric as illustrated in FIG. 2. Each aperture 25 can receive an independent heating device 30, supported, at least at one of its ends, against the stripped part of the bottom plate 22, and its other end is a front part intended to come into contact with the back of a printing plate 17, plated and fastened against the external surface of the honeycomb chase 24.

Figure 3:
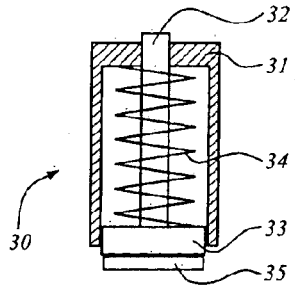
FIG. 3 shows schematically and partially a vertical cross section of a heating element of the device of the invention.

FIG. 3 is a diagrammatic illustration of a heating device 30 of the device 20 of the invention. Each heating device comprises in particular a cap 31 produced in an insulating material through which electrical current cannot be conveyed. This cap 31 is crossed by an electrode including primarily a rod 32. One end of the rod crosses the hole 26 through the insulating surface 23 and comes into contact with the bottom plate 22. The other end supports a base plate 33 that slides along the vertical axis of the rod. An elastic means, such as a compression spring 34, allows pushing of the base plate 33 toward the exterior side of aperture 25, facing the back of the printing plate 17. The compression spring 34 is preferentially interdependent, at its ends, respectively of the interior bottom of cap 31 and of the interior surface of base plate 33. The electric resistance 35 of the heating device 30 is fastened by unspecified means against the exterior side of the base plate 33. The elastic means urges the electric resistance 35 to remain always plated against the back of the printing plate 17 when the latter is mounted on the honeycomb chase 24. The heating device 30 is expected to come and clip into aperture 25 so that it is easily removable. However, any other fastening means allowing easy setting in and removal from aperture 25 is also appropriate.

To improve the contact of the electric resistance 35 against the back of the printing plate 17, the base plate 33 should be mounted onto a link, such as a pivot, authorizing perpendicularity defects between the longitudinal moving axis of the electric resistance 35 along the rod 32 and the plane formed by the back of the printing plate 17. Such a spherical roller would then take place at the junction of the base plate and the rod and would be, for example, assembled sliding along the latter.

From an electric point of view, the rod 32 and the base plate 33 constitute one of the electrodes of the tools supporting and heating device 20, whereas the honeycomb chase 24 and the printing plate 17 constitute the other electrode of said device. The bottom plate 22 is thus connected to the positive polarity of the electric power input and the honeycomb chase 24 is connected to the negative polarity so that the visible parts of the electric board, such as the chase and the printing plate, are connected to the mass and thus do not present any electrocution danger when the device is under electric tension. One understands thus the insulating plate 21, the insulating surface 23 and the insulating cap 31 acting to electrically separate the bottom plate 22 from all other parts of the device 20 connected to the mass of the platen press 1. Since the source of electric power of the present invention is not specifically concerned here, it will thus not be described with more details. In the same way, the network of electric wires enabling the connection of the bottom plate 22 and the honeycomb chase 24 with the respective terminals of the electric input is not of specific use here. One however mentions that these connections are usefully achievable in a very simple way, as the bottom plate and the honeycomb chase are easy to access, particularly from the outside. One will however note that the device 20 of the invention advantageously does not comprise any network of internal conducting wires for the feeding of its own electric means.

The printing plates 17 are fastened by means of fastening clamps into some selected apertures of the honeycomb chase, at the edge of the printing plate 17. For reasons of clearness, these fastening means are not represented on FIG. 2. However, the device 20 of the invention advantageously allows keeping this fastening means of the printing plates. There is thus no requirement for the user to invest for a specific fastening means for the device of the invention.

Advantageously, the electric resistances 35 can be, for example, ceramics chips like those in heating glue guns used in the field of the building industry. They are thus easily found in retail shops. These chips are generally of various types, each one corresponding to a different ohmic strength. The device of the invention can thus advantageously be equipped with different electric resistances 35, according to the specific job to be achieved within the platen press. It is thus also possible to have at the same time in device 20 several chips of different ohmic strengths. It thus becomes possible to apply more heat at a part of one printing plate as compared to another one or compared to the rest of the printing plate, for example.

Advantageously, the device of the invention allows a choice of arranging the heating devices 30 on the whole surface of the chase 24, and more judiciously to arrange them at least inside the areas covered by the printing plates 17. Thus, only the latter and their respective covered areas will really be heated by the heating devices 30. Moreover, one will note that the chips forming the electric resistances 35 are directly connected to the printing plate 17. This results in a quite important saving of energy.

More advantageously, some kinds of these electric resistances could have a capacity of inherent regulation for each one of the chips. These chips could indeed have a chemical structure whose ohmic strength varies according to the variation between the real temperature of the chip and a related maximum temperature. The regulation of the electrical current consumed by each resistance would be automatically and independently carried out until the chip reaches the maximum reference temperature for which it was designed. Thus, the heating devices 30 located near the blower 18 would automatically absorb more electrical current than those located more in the middle of the honeycomb chase, so as to compensate for the loss of heat produced by the air volume displacement of the blower. Thanks to this local compensation, which could sometimes even be specific, a printing plate 17 located in front of the blower 18 could thus be almost uniformly heated to a reference value. Lastly, one will note that, with this kind of chips, it would not be necessary to any more systematically deal with temperature sensors for checking the regulation of the various heated areas.

When one has to convert a platen press that was initially intended for diecutting to a platen press 1 intended for stamping metallized foils, one notes, on the one hand, that the tools supporting and heating device 20 of the present invention comprises only a few parts and, on the other hand, that the parts almost all look like plates and can be very easily assembled against the plain upper platen of any kind of platen press. Inversely, the disassembly of the device 20 so as to equip the platen with diecutting tools for cardboard sheets is easier to deal with.

Figure 4:
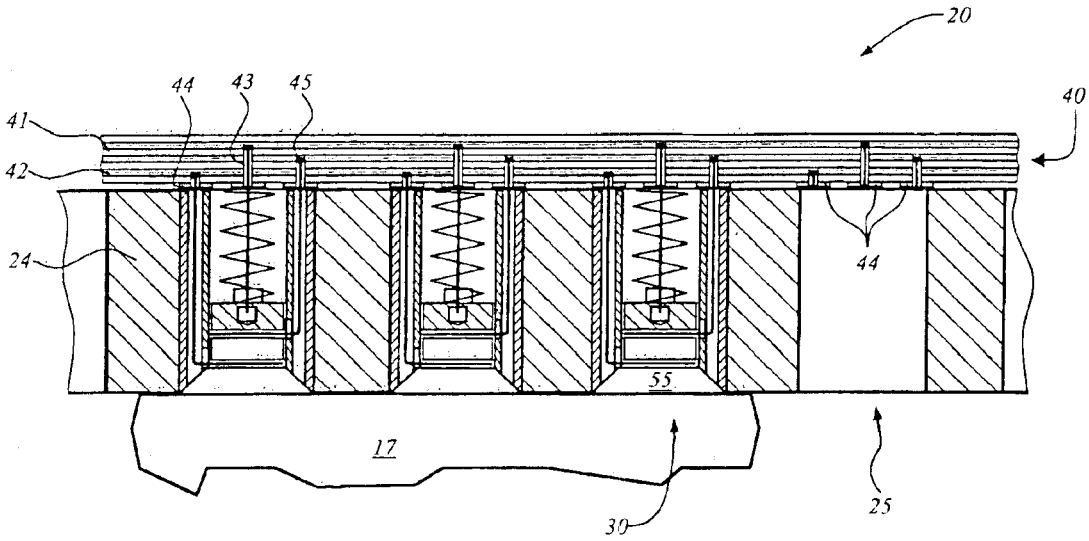
FIG. 4 shows schematically and partially a vertical cross section of an alternative to the device illustrated in FIG. 2.

FIG. 4 illustrates an alternative to the preferred embodiment of the invention. This alternative consists in using a base plate 40 comprising a plurality of indissociable successive layers, insulating 41 and conducting 42, instead of the insulating plate 21, of the base plate 22 and of the insulating surface 23. Such plates are known as multi-layer printed circuits and are commonly used in the field of electronics and data processing for the embodiment of electronic boards, such as graphics cards, mother boards or extension cards, for example. Used as a support, these multilayer circuits are thus like a milfoil of conducting and insulating layers onto which electronic components are usually wired.

Such a multilayer circuit is advantageously very light and very thin and usually comprises at least three conducting layers 42, each separated from the others by interconnected insulating layers 41. One although deals with common printed circuits comprising up to 16 electric layers, even sometimes 22 layers for some special applications. While having for example three conducting layers, it is then possible to apply simultaneously to this printed circuit two different electric voltages. One of these voltage, of about 230V for example, can be used to convey the energy needed for the various electric resistances 35, whereas the second voltage, of about approximately 5V, can be used to convey a pilot signal for the reference temperature of said electric resistances, for example. In order to control some resistances 35 independently from the others, it is also possible, either to foresee a division of the conducting layer intended for the low voltage, or to increase as much as necessary the number of layers each one intended for conveying an independent low voltage signal. One will also note that, in the case of a printed circuit made of three conducting layers, the third layer will be connected to the ground (potential 0V) to provide the return for the electric currents travelling through the two other conducting layers. So that the electric current can be conveyed to the surface, from the various internal conducting layers 42 towards external surface contacts 44, the electronic cards are usually equipped with connectors 43, like small insulated metallic rivets, that cross all the upper conducting layers, without producing any electric contact, until they reach their final layer to which they are electrically and mechanically connected by a welding 45.

It thus becomes possible to obtain on the surface of the multilayer printed circuit several contacts 44, of different voltages, which can be easily used to feed all types of electric units or electronic devices. Such units and/or devices can perfectly be comprised an alternative to the heating device 30. This alternative is schematically illustrated on FIG. 5 by another heating device 30 intended to be used with a base plate 40, that is preferentially made up of three conducting layers 42, and of as many contacts 44 on its surface. The heating device 30 comprises an insulation envelope 51 similar to the cap 31 illustrated in FIG. 3. Inside the envelope 51 there is an insulating blanket 52 comprising the main requested devices, namely a piston 53 moved by an elastic actuator 54 such as a compression spring, an electric resistance 35, a conducting hood 55 and an electronic device 56 taken as a measuring component such as a temperature sensor, for example. The electric resistance 35 is connected to an average voltage source by means of a first electrode 61 intended to be connected to one of the contacts 44 whose potential is equivalent to the voltage of 230V for example, and by means of a second electrode 62 intended to be connected to a second contact 44 whose potential is equivalent to a negative voltage for example. A third electrode 63, intended to be connected to the last contact 44, enables the electronic device 56 to be under a low voltage, of 5V for example, thanks to the difference of voltage between the second and the third electrode. Electrodes 61, 62 and 63 are evenly distributed around the insulating blanket 52 and cross the latter through passages 57, so as to be connected to the appropriate electric device or electronic component. Once this heating device inserted into one of the apertures 25 of the honeycomb chase 24, the free ends of each electrodes 61, 62, 63 come to connect themselves with the respective contacts 44 of the base plate 40. The electric and electronic devices comprised in the heating device can then be correctly fed.

Figure 5:
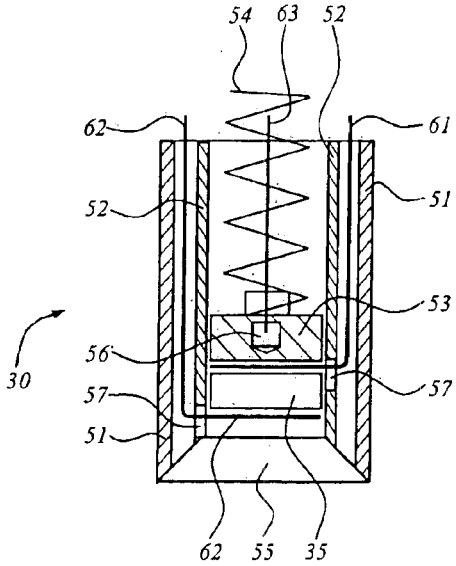
FIG. 5 shows schematically a cross section of an alternative heating element illustrated in FIG. 4.

One will note that for the abovementioned alternative of the heating device 30, the piston 53 is preferentially made up of an insulating matter. However, it would be possible to remove the electrode 61 so as to convey the electrical current by the combination of an elastic actuator 54, acting like a spring, and of a piston 53, both conducting. The electronic device 56 shown as an example illustrated with FIG. 5, is arranged inside the piston 53. However, it could be planned to remove it preferentially into another housing, inside the cap 55 for example. One notes thus that several alternatives are perfectly suitable, as much mechanically speaking as electrically speaking. Related to that point, the cap 55 is acting here for doubling the contact surface of the electric resistance 35, improving thus the heat distribution against the printing plate 17, while keeping this chip safe inside the envelope 51. This cap 55 can as well be produced of a material such as copper or mica, so far as this material has a good thermal conductivity. However, it could be also deemed to remove this cap 55 or to simply substitute it by the electronic measuring device 56. It is quite clear that the number of electrodes planned in the alternative the heating device 30 could be different so as to obtain either an improvement of said element or a simplification of its process for example.

The above mentioned alternatives for the present invention make it even possible to substitute for the conducting honeycomb chase 24 with a same or identical one but produced from an insulating material. Indeed, one notes that the electric circuit of the heating device 30, as shown by the various electrodes 61, 62, 63, does not require use with a honeycomb chase made of a conducting material. Another advantage thus directly results from the appreciable reduction of the mass of such a frame. Its handling is thus easier, faster and can even be carried out manually without needing a lifting apparatus.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A support and heating device for tools for hot embossing or diecutting with hot pressure transfer of metallic film portions onto a substrate, the device comprising:

at least one platen;

at least one honeycomb chase having two opposite parallel sides with a plurality of apertures at spaced apart locations in the chase;

a base plate secured against one of the sides of the honeycomb chase, the base plate comprised of at least one insulating surface alternating with at least one conducting surface;

a plurality of heating devices, each inserted into one of the apertures in the honeycomb chase, and the heating devices being operable to heat a printing plate that is selectively securable against the second side of the honeycomb chase, the printing plate being positioned for cooperating with the at least one platen for hot embossing or diecutting and hot pressure transferring a metallic film portion onto the substrate.

2. The device of claim 1, wherein the base plate comprises a bottom plate which is a conducting plate;

an insulating plate at one side of the bottom plate;

an insulating surface at an opposite side of the bottom plate;

a respective hole in the insulating surface located at each of the apertures in the honeycomb chase, whereby each of the holes communicates with a respective one of the apertures in the honeycomb chase.

3. The device of claim 2, wherein each of the heating devices includes an insulating cap and an electrode passing out of the cap, the electrode having a first end that leans against the conducting bottom plate of the base plate by passing through the aperture in the insulating surface, the electrode having an opposite second end and an electric resistance toward the second end of the electrode positioned and operable to come into contact with a printing plate secured against one of the sides of the honeycomb chase.

4. The device of claim 3, wherein the second end of the electrode comprises a second base plate; an elastic device for conveying the second base plate of the electrode toward an exterior edge of the aperture.

5. The device of claim 4, further comprising a link to which the second base plate is attached.

6. The device of claim 2, wherein the bottom plate of the base plate is connected to a positive terminal of an electric energy source.

7. The device of claim 2, further comprising a positive terminal of an electric energy input to which the bottom plate is connected, and the electric energy input has a negative terminal to which the honeycomb chase is connected.

8. The device of claim 1, wherein the base plate has a plurality of multi-layered printing circuits, each circuit including a plurality of connectors and the connectors are arranged to the apertures of the honeycomb chase for the heating devices.

9. The device of claim 8, wherein the heating device includes an envelope in which a plurality of the electrodes are arranged, each of the electrodes having a first end connected to one of polarities of an electric device or at least one electronic body, and each electrode a second end intended to contact with a respective one of the connectors of the base plate.

10. The device of claim 9, wherein at least one of the electric devices is an electric resistance.

11. The device of claim 10, wherein the electric resistance of the heating device is comprised of a chip having a chemical composition selected to have an ohmic strength variable according to a difference between the real temperature of the electric resistance and a maximum control temperature.

12. The device of claim 9, further comprising a piston in the aperture and connected to an elastic actuator, the piston sliding along the inside of the aperture and the electrodes are interdependent of the piston, the piston being moveable by the elastic actuator outward of the aperture.

13. The device of claim 12, further comprising an envelope inside the aperture, a blanket inside the envelope and the piston being slidable inside the envelope in the aperture along the blanket.

14. The device of claim 12, wherein the elastic actuator is comprised of one of the electrodes.

15. The device of claim 8, wherein the honeycomb chase is comprised of an insulating material.

16. The device of claim 1, wherein the heating devices are removable from and are clipped into the respective apertures of the honeycomb chase.

17. The device of claim 1, wherein the device comprises a platen press including means therein intended for diecutting or embossing a substrate.

* * * * *